US005372193A

United States Patent [19]

French

[11] Patent Number: 5,372,193

[45] Date of Patent: Dec. 13, 1994

[54] COMPLETION TEST TOOL

[76] Inventor: Clive J. French, 60 St. Swithin Street, Aberdeen, AB 1 6XJ, Scotland

[21] Appl. No.: 54,760

[22] Filed: Apr. 29, 1993

[30] Foreign Application Priority Data

Nov. 13, 1992 [GB] United Kingdom ..... 9223888

[51] Int. Cl.[5] ..... E21B 47/10; E21B 34/10

[52] U.S. Cl. ..... 166/250; 166/113; 166/319; 166/386

[58] Field of Search ..... 166/250, 386, 374, 319, 166/332, 113

[56] References Cited

U.S. PATENT DOCUMENTS

| | | | |
|---|---|---|---|
| 3,662,834 | 5/1972 | Young | 166/319 X |
| 3,750,752 | 8/1973 | Mott | 166/319 |
| 3,981,360 | 9/1976 | Marathe | 166/319 X |
| 4,258,793 | 3/1981 | McGraw et al. | 166/374 |
| 4,434,854 | 3/1984 | Vann et al. | 166/386 |
| 4,560,005 | 12/1985 | Helderle et al. | 166/332 |
| 4,848,457 | 7/1989 | Lilley | 166/332 X |
| 4,856,756 | 8/1989 | Combs | 166/332 X |
| 5,048,611 | 9/1991 | Cochran | 166/319 X |

FOREIGN PATENT DOCUMENTS

| | | | |
|---|---|---|---|
| 1242443 | 8/1971 | United Kingdom . | |
| 621860 | 8/1978 | U.S.S.R. | 166/319 |

OTHER PUBLICATIONS

Excerpts from Baker Sand Control products brochure, describing Product No. 302–41, author and publication date unknown.

Exerpts from Schlumberger products brochure, pp. 2–67 thru 2–70, describing Multicycle Circulating Valve Tool, author and publication date unknown.

*Primary Examiner*—Hoang C. Dang

*Attorney, Agent, or Firm*—Krass & Young

[57] ABSTRACT

A completion test tool for location in a tubular string comprises: a body for mounting on the string and having a wall defining a longitudinal bore and a port for fluid communication between the bore and the exterior of the tool. A valve member in the form of a sleeve is mounted on the body, in a first configuration the valve member being configured to allow fluid to flow through the port and in a second configuration the valve member being configured to close the port. The valve member is movable from the first configuration to the second configuration in response to a positive pressure differential between the bore and the tool exterior.

12 Claims, 3 Drawing Sheets

COMPLETION TEST TOOL

FIELD OF THE INVENTION

This invention relates to a completion test tool for use in testing the completion, or pressure integrity, of a string of interconnected tubular sections.

BACKGROUND OF THE INVENTION

When carrying out testing or other operations in deep bores, such as gas and oil wells, test equipment or other apparatus such as, for example, a casing perforating gun assembly, may be mounted on an end portion of a string of tubular sections, known as tubulars. The apparatus is lowered into the bore on the end of the string, the length of the string being increased by the addition of further tubulars, which are threaded together to define a continuous internal bore between the apparatus and the surface. As the successful running of certain tests, and the operation of many forms of apparatus, relies on the integrity of the string it is essential that the string is fluid tight. However, as the string is being lowered into the bore it is desirable that the string is filled with the fluid or mud in the well bore, surrounding the string. Accordingly, it is necessary to provide a tool which will allow fluid to flow into the string but which tool may also be activated to close the string to allow the integrity of the string to be tested. Existing tools for this purpose, in the form of tubing test valves, are located towards the lower end of the string and include flapper valves in the string bore which are pushed open if the external or annulus fluid pressure is greater than the internal string pressure, but are closed in the absence of such a pressure differential by a valve spring. The pressure integrity of the string above the valve may thus be tested by pumping down on top of the valve and monitoring the pressure at the surface. Such flapper valves generally operate satisfactorily, but the valve and valve seating restricts the internal bore diameter. Also, when the valve is open on run in, the well fluid flows over the valve sealing surfaces, which may result in wear to the surfaces and a loss of seal integrity.

A somewhat different valve arrangement is utilised in the Schlumberger Multicycle Circulating Valve (MCCV) tool, which is a recloseable valve, operating from internal fluid, or tubing pressure. The tool has an inner mandrel with a set of ports that can align with either reversing or circulating ports, or can close the ports for completion testing. The mandrel defines an internal piston and pressure cycles are used to move the mandrel between the three positions, the cycles moving a pin on a ratchet.

A tool operating in a generally similar manner is the Baker Sand Control Multi-Reverse Circulating Valve. Both this and the Schlumberger MCCV tool are of relatively large dimensions and thus restrict the inside diameter of the string in which they are fitted. Also, the relatively large outer diameters of the tools prevent them from being utilised in applications which require location of such tools below a well bore packer..

It is among the objects of the present invention to provide a tool which obviates or mitigates these disadvantages.

SUMMARY OF THE INVENTION

According to the present invention there is provided a completion test tool for location in a tubular string or wireline, the tool comprising:

a body for mounting on a string or wireline, the body having a wall defining a longitudinal bore and a port for fluid communication between the bore and the exterior of the tool;

a valve member in the form of a sleeve mounted externally of the body, in a first configuration the valve member being configured to allow fluid to flow through the port and in a second configuration the valve member being configured to close the port; and means for moving the valve member from said first configuration to said second configuration responsive to a positive pressure differential between the bore and the tool exterior.

In use, the test tool may be located towards the lower end of a string below the packer or annulus production zone isolation seal. As the string is lowered into a bore the valve member is maintained in the first configuration, allowing fluid to flow through the port and fill the string. To test the integrity, or completion, of the string, a positive internal pressure may be produced by pumping fluid down the string at a flow rate greater than the rate that fluid can flow from the bore through the port. The valve member moving means thus closes the valve to seal the tool. Any subsequent drop in pressure in the string indicates that the string is not fluid tight. On ceasing of the application of pressure to the string bore the valve member may return to the first configuration and the fluid may continue to flow into the string as the string is extended by the addition of further tubulars at the surface.

The tool may also be provided on the lower end of a wireline, for location below a wireline lock.

The provision of a valve member in the form of an external sleeve does not restrict the internal diameter of the body, and the external diameter of the sleeve, and thus the diameter of the tool, may also be kept to a minimum.

Preferably, the tool includes means for biasing the valve member towards the first configuration, conveniently in the form of a compression spring or the like. This provides for fail-opened operation.

Preferably also, the sleeve defines a port which, in the first configuration, is aligned with the body port, and in the second configuration a portion of the sleeve extends over and closes the body port. The diameter of the sleeve port may be varied, to vary the pump rate necessary to close the valve.

Preferably also, the sleeve defines a piston and a piston chamber is defined between the sleeve and the exterior of the body, a piston chamber port being provided in the body wall for communication of fluid pressure from the body bore to the chamber.

Preferably also, the test tool is adapted for location on a drill string or production string below a seal assembly for sealing engagement with the seal bore of a permanent packer. A well bore provided with a casing is often provided with a packer which includes a seal bore of smaller diameter than the casing, sometimes known as the polished bore receptacle (PBR). The seal assembly of the string is sized to fit snugly within the seal bore and typically comprises alternate bands of metal and elastomer, so that slight movements relative to the seal bore do not affect the seal between the string and the packer. In such applications, the lower end of the sleeve, which is slightly larger than a tubular diameter, provides a stop for the string on engaging a diameter restriction, or muleshoe, provided on the lower end of the seal bore. Conveniently, the means for mounting the sleeve on the body is releaseable, preferably by means of shear pins, such that the sleeve may be released from the body and the string lowered further through the packer. The stop provided by the sleeve may serve as a convenient datum for conducting spaceout of the string: it is impossible to pre-calculate with great accuracy the length of string required to locate exactly the seal assembly of the string in the packer. The standard technique used is to calculate the string length approximately, and continue adding tubulars to the string until a stop, in this case the sleeve, engages a landing surface of the packer. The exact length of string required is thus determined and the string may be partially withdrawn and other devices or tools added to or 'spaced out' on the string at appropriate locations. As the length of the added devices and tools is known, when the string is reinserted the seal assembly may be accurately positioned within the seal bore to provide an effective seal between the areas of the well bore above and below the packer.

According to a further aspect of the present invention there is provided a method of testing the completion of a string comprising:

providing a tool in the string including a hollow body having a wall defining a port and a valve member in the form of a sleeve mounted externally of the body and responsive to a pressure differential between the interior of the body and the tool exterior;

positioning the valve member in a first configuration to allow fluid to flow through the port;

pumping fluid into the string at a flow rate above that which may be accommodated by said port to create a positive pressure differential-between the interior of the body and the tool exterior and thus move the valve member to a second configuration to close the port;

applying a test pressure to the interior of the string; and monitoring said pressure to determine if the string is complete.

BRIEF DESCRIPTION OF THE DRAWINGS

These and other aspects of the present invention will now be described, by way of example, with reference to the accompanying drawings, in which.

DETAILED DESCRIPTION OF DRAWINGS

Figure 1:
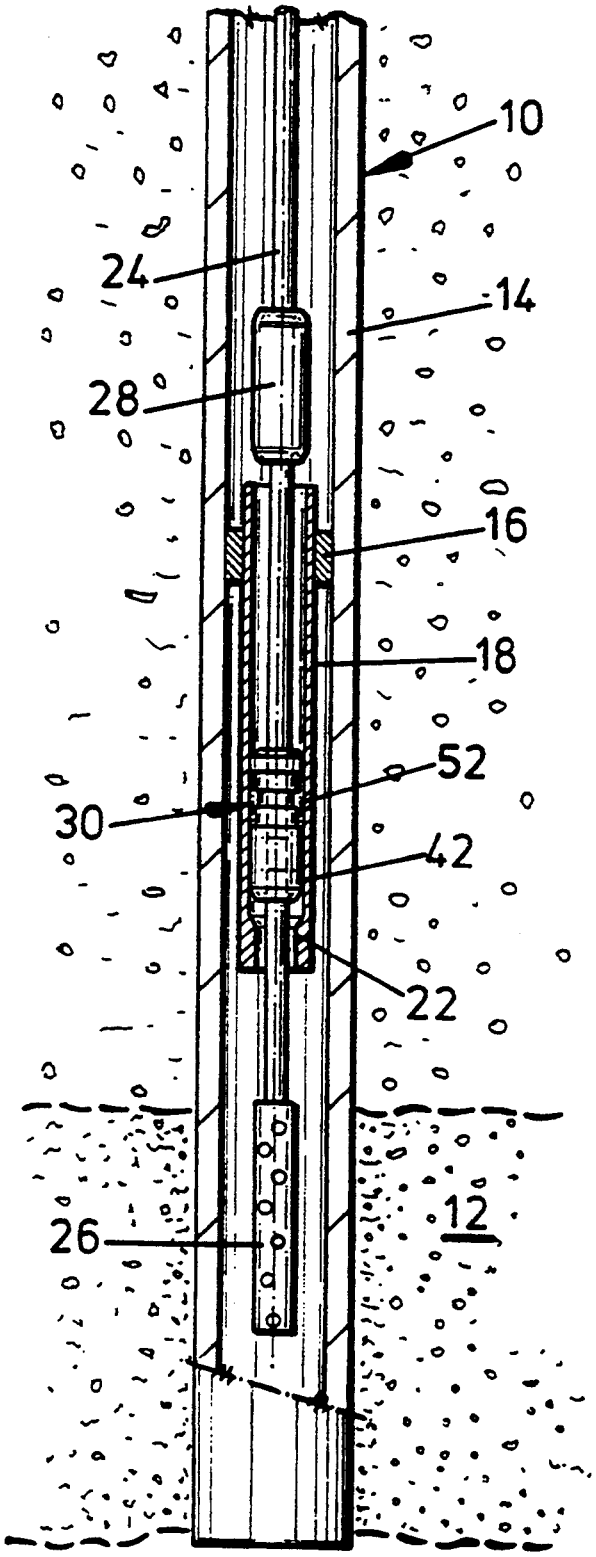
FIG. 1 is a sectional view of the lower end of an oil well bore, a string including a completion test tool in accordance with a preferred embodiment of the present invention being located in the bore.

Reference is first made to FIG. 1 of the drawings which shows the lower end of a well bore 10 which extends into oil-bearing strata 12. The bore 10 is lined by a steel casing 14 and mounted within the casing 14 is a permanent packer 16 which provides mounting for a cylindrical tube defining a seal bore 18. A landing surface, in the form of a muleshoe 22 is located at the lower end of the seal bore 18. Located in the bore 10 is a string 24 which extends from the surface and comprises a large number of threaded tubulars and, in the illustrated example, provides mounting for a gun assembly 26, a seal assembly 28 and a completion test tool 30 in accordance with a preferred embodiment of the present invention. The test tool 30 may be used together with a wide range of tools, though will be described below with reference to use in conjunction with the gun and seal assemblies 26, 28. The gun assembly 26 is used to perforate the casing 14 where the bore 10 passes through the oil bearing strata 12. While the gun 26 is being operated, the seal assembly 28 is located in the seal bore 18 and thus isolates the lower end of the bore.

As mentioned above, the string 24 is formed of a plurality of threaded sections and it is of course desirable to ensure that the connections between the sections are secure and fluid tight. However, it is also desirable that the hollow string 24 be filled with the well fluid or mud that fills the bore 10 as the string 24 is lowered through the bore. For this purpose, the completion test tool 30 provides means for permitting fluid communication between the bore 10 and the interior of the string 24 which means may be selectively closed to allow testing of the integrity, or completion, of the string 24.

Figure 2A:
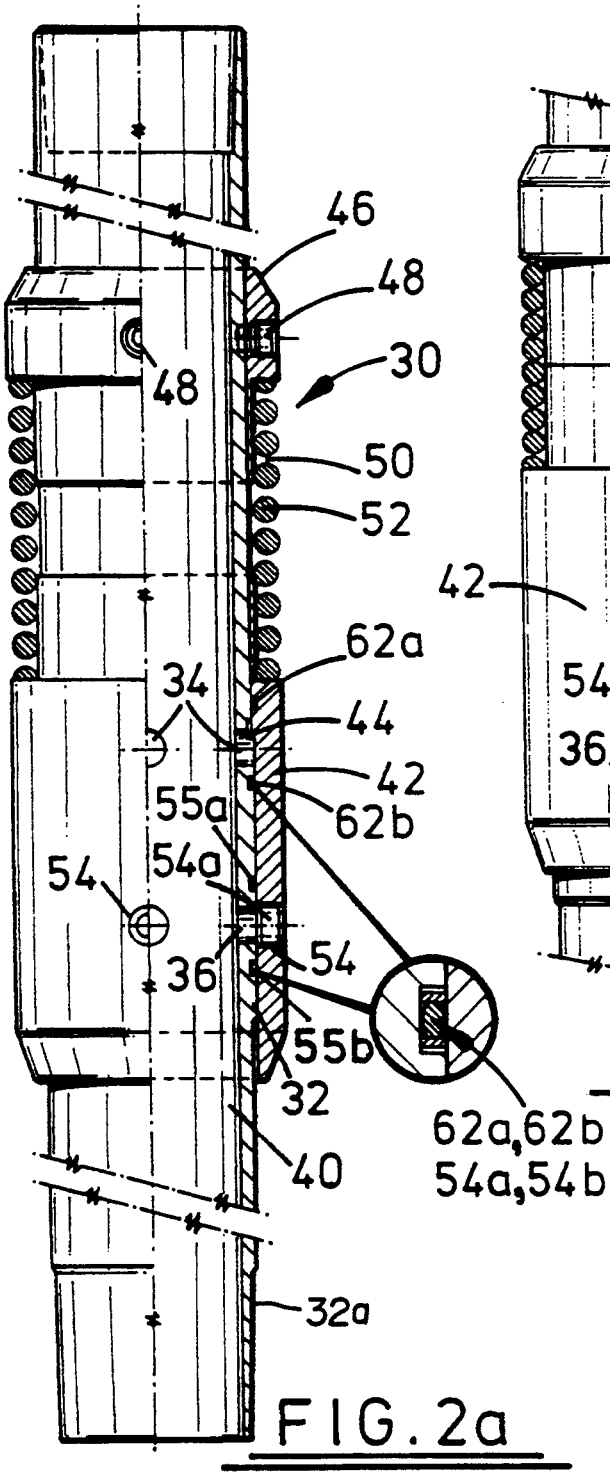
FIGS. 2*a* and 2*b* are enlarged sectional views of the completion test tool of FIG. 1, FIG. 2*a* showing the tool in an open configuration, and FIG. 2*b* showing the tool in a closed configuration.
Figure 2B:
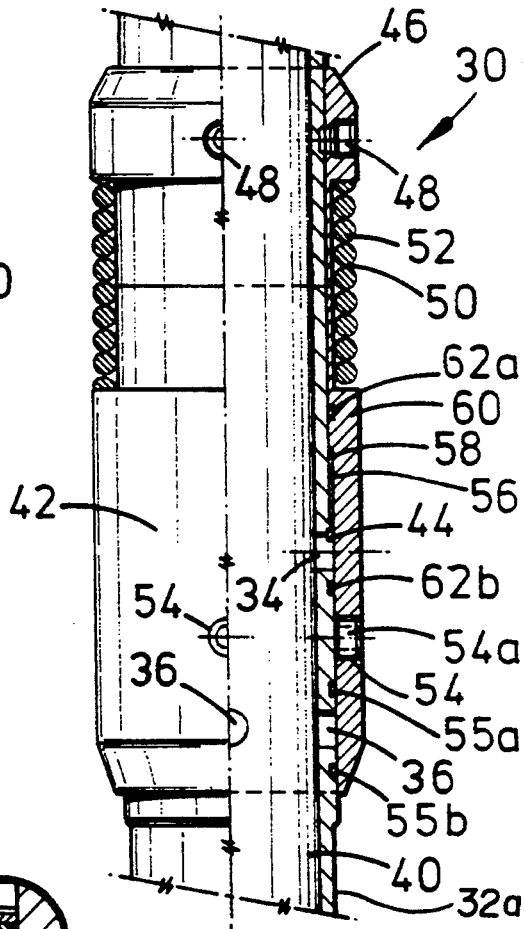

Reference is now also made to FIGS. 2*a* and 2*b* of the drawings which illustrate the completion test tool 30 in more detail. The tool 30 comprises a body 32 having threaded ends for locating the tool between tubulars and the body defining an annular wall 32*a* which defines a longitudinal bore 40 of similar diameter to the bore defined by the tubulars. The wall 32*a* also defines radially spaced ports 34, 36.

Mounted on the body 32 is a valve member in the form of a sleeve 42. In FIG. 2*a* the sleeve 42 is shown in a first configuration and FIG. 2*b* shows the sleeve 42 in a second configuration. Stops for the sleeve 42 are provided by interengaging ledges 44 which will limit the downward travel of the sleeve 42 relative to the body 32, whereas upward movement of the sleeve 42 relative to the body 32 is limited by a mounting 46 fixed to the upper portion of the body 34 by shear bolts 48. The outer face of the mounting 46 defines an annular recess 50 which accommodates a compression spring 52, the lower end of which bears against an upper end portion of the sleeve 42.

The sleeve 42 defines a number of radially spaced ports 54 which, in the first configuration, are aligned with the ports 36 to provide for fluid communication between the bore 40 and the tool exterior. Removably located within the ports 54 are annular orifice plugs 54*a*. In the second configuration, the sleeve 42 has been moved upwardly relative to the body 32 to bring the ports 36, 54 out of alignment and thus seal the bore 40. Annular seals 55*a*, 55*b* are provided on the body above and below the ports 36.

Movement of the sleeve 42 between the first and second configurations is provided by a positive pressure differential between the bore 40 and the tool exterior acting on a sleeve piston, as described below.

The ports 34 in the upper portion of the body 34 communicate with an annular chamber 56 defined between the upper portion of the body 32 and the sleeve 42, the upper wall of the chamber being formed by an annular piston 58 defined by an annular flange 60 on the inner face of the sleeve 42. Seals 62*a*, 62*b* are provided on the inner face of the flange and on the outer surface of the middle portion of the body 32 to isolate the chamber 56.

In use, the tool 30 is located in the string 24 as it is assembled and, in this example, the tool 30 is located between a gun assembly 26 and a seal assembly 28. As the length of the string 24 is increased by adding tubulars at the surface the lower end of the string is moved further into the bore 10. Normally, the action of the spring 52 biases the sleeve 42 into the first configuration such that the ports 36, 54 are aligned and the mud that fills the bore 10 may flow through the ports and fill the internal string bore. If it is desired to test the completion of the string, mud is pumped into the string 24 at a rate of, for example, three barrels per minute. This flow rate is selected to be greater than the rate of flow of fluid through the ports 36, 54 such that the pressure within the string will increase. The flow rate required to produce this effect may be varied by fitting different orifice plugs 54*a* in the ports 54. When the pressure differential is at a sufficient level the pressure force on the piston 58 will move the sleeve 42 upwardly, against the action of the spring 52, and close the ports 36. A test pressure of, for example, 10,000 psi is then applied and the pressure of the fluid monitored at the surface, a drop in pressure indicating that the string is not complete.

If the internal string pressure is then bled off the spring 52 will return the sleeve 42 to the first configuration and the string 24 may continue to be lowered through the bore 10.

Figure 3:
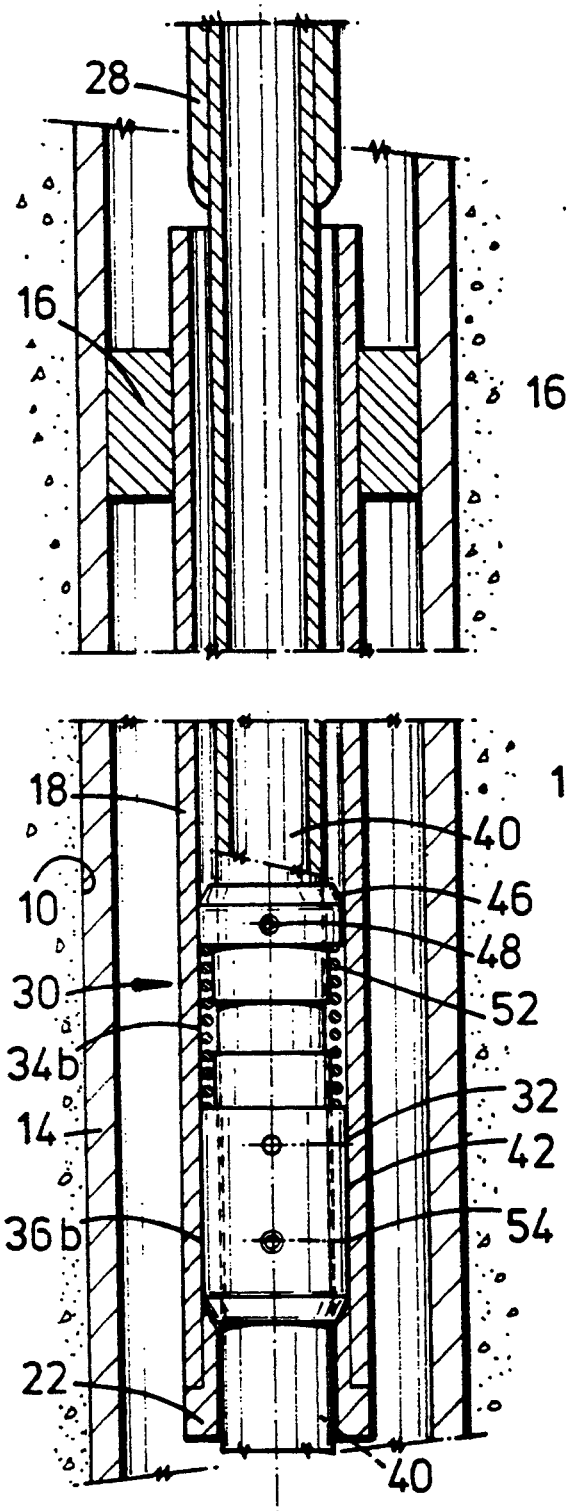
FIGS. 3 and 4 are enlarged sectional views of the completion test tool of FIG. 1, shown on a string and located within a permanent packer.
Figure 4:
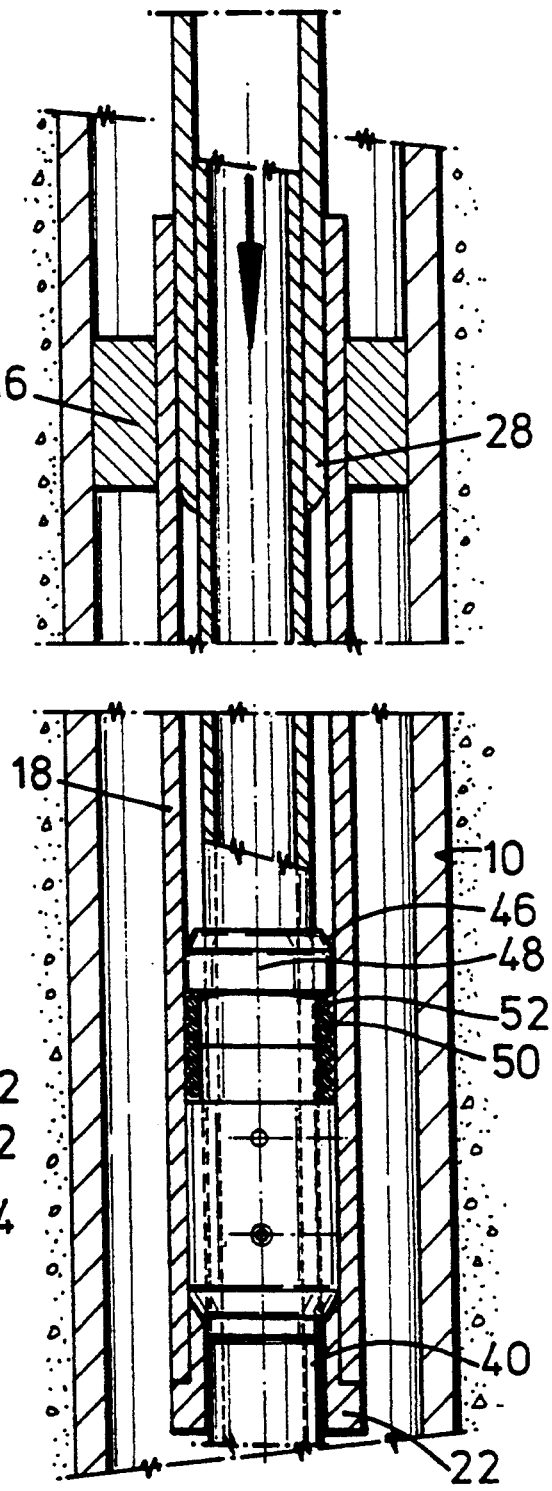

Reference is now made to FIGS. 3 and 4 of the drawings which illustrate a preferred feature of one aspect of the present invention. FIG. 3 shows the tool 30 after it has passed into the seal bore 18 of the packer 16. The external diameter of the sleeve 42 has been selected to allow the tool 30 to pass into the bore 18 but the lower end of the sleeve 42 will engage the muleshoe 22 at the lower end of the seal bore 18. Thus, the tool provides a convenient stop for the string 24 and accurately indicates the location of the packer 16 in the casing 14. To ensure that the tool 30 is properly engaged with the muleshoe 22 the operator may apply a load of, for example 10,000 pounds to the string.

After the location of the packer 16 has been confirmed, the string 24 may be retracted to some degree and further tools located on the upper end of the string 24. The completion of the string may then be tested again using the tool 30, as described above.

It will be noted from FIG. 3 that the spacing between the tool 30 and the seal assembly 28 is such that when the sleeve 42 lands on the muleshoe 22 the seal assembly 28 is above the seal bore 18. For operation of the gun 26, and subsequent testing operations, it is essential that the seal assembly 28 is properly located within the seal bore 18. Accordingly, if a large load of, for example, 20,000 pounds, is applied to the string 24 the bolts 48 will shear allowing the body 32 to move downwardly relative to the sleeve 42, through the muleshoe 22, and allow the seal assembly 28 to move into proper engagement with the seal bore 18, as illustrated in FIG. 4 of the drawings.

From the above description it will be noted that the tool 30 is of simple construction and is therefore relatively inexpensive to produce and reliable in operation. Also, the tool is operated by means of application of fluid pressure to the string bore and thus may be operated with conventional technology, and does not require a wireline. Further, the tool 30 may be located on a string 24 to be positioned below a packer and thus does not affect the pressure integrity of the string above the seal between the string seal assembly and the packer. Also, the configuration of the tool does not restrict the internal bore of the string 24.

It will be obvious to those of skill in the art that the above described embodiment is merely exemplary of the present invention and that various modifications and improvements may be made to the described embodiment without departing from the scope of the invention.

I claim:

1. A completion test tool for location in a tubular string or wireline, the tool comprising:

a body for mounting on a string or wireline, the body having a wall defining a longitudinal bore and a port for fluid communication between the bore and the exterior of the tool;

a valve member in the form of a sleeve, mounted externally of the body, and movable between first and second configurations, in the first configuration the valve member being configured to allow fluid to flow through the port and in the second configuration the valve member being configured to close the port;

means for biasing the valve member towards the first configuration; and means for moving the valve member from said first configuration to said second-configuration in response to a positive pressure differential between the bore and the tool exterior.

2. The tool of claim 1, in which the biasing means is in the form of a compression spring.

3. The tool of claim 1, in which the sleeve defines a port which, in the first configuration, is aligned with the port in the body, and in the second configuration a portion of the sleeve extends over and closes the port in the body.

4. The tool of claim 3, in which the port in the sleeve is provided with a removable plug defining a predetermined flow area.

5. The tool of claim 3, in which the sleeve defines a piston, and a piston chamber is defined between the sleeve and the body, a piston chamber port being provided in the body wall for communication of fluid pressure from the body bore to the piston chamber.

6. The tool of claim 1, in which the lower end of the sleeve defines a landing surface.

7. The tool of claim 6 including means for releasably mounting the sleeve on the body, release of the sleeve mounting means permitting axial movement of the sleeve relative to the body.

8. The tool of claim 7, in which the sleeve mounting means is in the form of shear pins.

9. A tubular string including: the tool of claim 1; and a seal assembly for location within a seal bore mounted on a well packer within a well bore, wherein the tool is mounted below the seal assembly.

10. A method of testing the completion of a drill or production string, the method comprising:

providing a tool in a string, the tool including a hollow body having a wall defining a first port and a valve member in the form of a sleeve defining a second port mounted externally of the body and movable in response to a pressure differential between the interior of the body and the tool exterior;

positioning the valve member in a first configuration to allow fluid to flow through the ports;

pumping fluid into the string at a flow rate above that which may be accommodated by one of said ports to create a positive pressure differential between the interior of the body and the tool exterior and move the valve member to a second configuration to close the one of said ports;

applying a test pressure to the interior of the string; and monitoring said pressure to determine if the string is complete.

11. A completion test tool for location in a tubular string or wireline, the tool comprising:

a body for mounting on a string or wireline, the body having a wall defining a longitudinal bore and a port for fluid communication between the bore and the exterior of the tool;

a valve member in the form of a sleeve, mounted externally of the body, and movable between first and second configurations, in the first configuration the valve member being configured to allow fluid to flow through the port and in the second configuration the valve member being configured to close the port, the sleeve defining a port which, in the first configuration, is aligned with the port in the body, and in the second configuration a portion of the sleeve extends over and closes the port in the body; and means for moving the valve member from said first configuration to said second configuration in response to a positive pressure differential between the bore and the tool exterior.

12. The tool of claim 11, in which the sleeve defines a piston, and a piston chamber is defined between the sleeve and the body, a piston chamber port being provided in the body wall for communication of fluid pressure from the body bore to the piston chamber.

* * * * *